US006484929B2

(12) United States Patent
Sumpmann et al.

(10) Patent No.: US 6,484,929 B2
(45) Date of Patent: Nov. 26, 2002

(54) CANISTER FOR A PARTICULATE-TYPE PRODUCT

(75) Inventors: Patrick Sumpmann, Maple Grove, MN (US); Gordon Meier, Brooklyn Park, MN (US); Curtis Deering, Maple Grove, MN (US)

(73) Assignee: General Mills, Inc., Minneapolis, MN (US)

( * ) Notice: Subject to any disclaimer, the term of this patent is extended or adjusted under 35 U.S.C. 154(b) by 55 days.

(21) Appl. No.: 09/746,238

(22) Filed: Dec. 22, 2000

(65) Prior Publication Data

US 2001/0011678 A1 Aug. 9, 2001

Related U.S. Application Data

(63) Continuation-in-part of application No. 09/328,917, filed on Jun. 9, 1999, now abandoned.

(51) Int. Cl.[7] ..... B65D 43/14

(52) U.S. Cl. ..... 229/125.09; 220/258.3; 220/266; 229/123.3; 229/125.05

(58) Field of Search ..... 229/123.2, 123.3, 229/125.05, 125.08, 125.09; 220/258.3, 266, 268

(56) References Cited

U.S. PATENT DOCUMENTS

| | | | | | |
|---|---|---|---|---|---|
| 1,931,991 | A | * | 10/1933 | Merentheim | 229/125.09 |
| 3,082,926 | A | * | 3/1963 | Powell | 229/123.3 |
| 3,262,632 | A | * | 7/1966 | Brady et al. | 229/123.3 |
| 3,756,493 | A | * | 9/1973 | Holmes | 229/125.09 |
| 4,453,666 | A | * | 6/1984 | Gordon | 229/125.09 |
| 4,768,703 | A | * | 9/1988 | Sosler et al. | 229/125.05 |
| 4,842,188 | A | * | 6/1989 | Lisiecki | 229/123.3 |
| 4,930,682 | A | * | 6/1990 | Gordon et al. | 229/123.2 |
| 5,566,529 | A | * | 10/1996 | Sireix | 53/412 |
| 6,082,614 | A | * | 7/2000 | Schmidt | 229/123.3 |
| 6,349,866 | B1 | * | 2/2002 | Stewart et al. | 229/125.09 |
| 6,355,286 | B2 | * | 3/2002 | Deering et al. | 229/123.2 |

* cited by examiner

*Primary Examiner*—Gary E. Elkins
(74) *Attorney, Agent, or Firm*—John A. O'Toole; Douglas J. Taylor; Timothy A. Czaja

(57) ABSTRACT

A canister for storing a particulate-type product. The canister includes a tubular body, a bottom panel, a top panel and a plurality of tabs. The tubular body defines an upper opening, a lower opening, and an internal storage region. The bottom panel is connected to the tubular body so as to encompass the lower opening. The top panel is similarly connected to the tubular body so as to encompass the upper opening and includes a lid. The lid is selectively secured to the tubular body at the upper opening such that the lid is moveable from an initial, closed state to an opened state, and from the opened state to a reclosed state. In the initial, closed state, the lid is secured to the tubular body. In the opened state, the lid is displaced from the tubular body to define a pour opening through which the internal storage region is accessible. In the reclosed state, the lid substantially encompasses the pour opening. Finally, the plurality of tabs are associated with the lid in at least the reclosed state. In one preferred embodiment, tab formation is completed as the lid is forced from the initial, closed state, and the tabs assist in frictionally securing the lid to the tubular body in the reclosed state.

51 Claims, 11 Drawing Sheets

CANISTER FOR A PARTICULATE-TYPE PRODUCT

CROSS-REFERENCE TO RELATED APPLICATIONS

This application is a continuation-in-part of application Ser. No. 09/328,917 filed Jun. 9, 1999, entitled "Canister for a Particulate-Type Product", Abandoned.

BACKGROUND OF THE INVENTION

The present invention relates to a canister for containing a particulate-type product. More particularly, it relates to a paper and plastic based canister for storing a particulate-type product, such as a ready-to-eat cereal, configured to satisfy consumer preferences.

An extremely popular form of packaging for dry, particulate-type products sold to consumers is a paper carton. A wide variety of different products are packaged in this form, ranging from consumable items such as cereals and baking goods to non-consumable items such as laundry detergents and de-icing salt pellets. Paper cartons present a number of advantages for manufacturers, retailers and ultimate consumers. For example, paper cartons are relatively inexpensive to manufacture and provide a number of flat surfaces onto which product or promotional information can be displayed. Further, paper cartons normally assume a rectangular, parallel-piped shape and are therefore readily stackable. Thus, a retailer can maximize shelf space while fully displaying the product. Obviously, consumers likewise find the stackability characteristic desirable for home storage. Finally, paper cartons are typically sized in accordance with consumer preferences such that a desired amount or volume of product is provided with each individual carton.

Certain types of products are amenable to storage within a paper carton alone. Generally speaking, however, a paper carton cannot, in and of itself, adequately maintain product integrity. For example, a paper carton likely will not prevent aroma, moisture, contaminants, small insects, etc. from passing through to the contained product. Thus, packaging for virtually all particulate-type products requires an additional container or liner disposed within the paper carton. This is especially true for consumable/food products. A widely accepted technique for maintaining product integrity is to place the product into an inner container or bag, that in turn is stored in the carton (commonly referred to as a "bag in a box"). The bag is typically made of a plastic or glassine material and is sealed about the product. In this sealed form, the bag maintains product freshness and protection against insect infestation, whereas the outer paper carton provides packaging strength and display. Alternatively, a double packaging machine (DPM) technique may be employed to form a plastic or glassine liner within a paper carton. Regardless of the exact manufacturing process, the resulting packaging configuration includes a box with an inner liner that serves as a barrier material. One readily available example of this packaging approach is a ready-to-eat cereal, although it should be understood that a wide variety of other products are similarly packaged.

The box with an inner liner packaging approach is universally employed. In fact, from a manufacturer's standpoint, box with an inner liner packaging satisfies a number of important criteria including low cost, stackability, and large, flat surfaces for displaying product and promotional information. Unfortunately, however, consumers may encounter several potential drawbacks. These possible disadvantages are perhaps best illustrated by reference to a ready-to-eat cereal product.

Most ready-to-eat cereal products are sold to consumers with the box with an inner liner packaging format. Thus, to consume the cereal, the user must first open the paper carton. In this regard, a top portion of the carton typically forms at least two flaps folded on top of one another. The flaps are normally at least partially adhered to one another with an adhesive. By pulling or otherwise tearing one flap away from the other, a consumer can then access the inner bag. An all too common problem is that the selected adhesive creates too strong of a bond between the flaps, making flap separation exceedingly difficult. In fact, consumers may become frustrated with the separation process and resort to partially or completely tearing both flaps away from the carton. A related problem is found with a reclosure feature often times incorporated into the flaps. For example, one of the flaps may be provided with a tab, whereas the other flap includes a perforated slot positioned to receive the tab for reattachment of one flap to the other. Obviously, where the consumer has torn both flaps from the carton, the reclosure feature is unavailable. Additionally, the reclosure feature is sometimes difficult for a consumer to understand and properly use. For example, consumers often tear the flap in the region of the slot such that the slot can no longer maintain the tab.

Once the carton has been opened, the consumer must then open the inner bag. Once again, this may be a cumbersome procedure. More particularly, an elongated seal is typically formed and extends along a top portion of the bag. This seal is broken (or "opened") by pulling apart opposite sides of the bag. In some instances, the so-formed seal is too rigid for simple opening. Even further, a person with reduced dexterity and strength, such as a child or elderly individual, may have difficulty in breaking an even relatively light seal. As a result, attempts at opening the inner bag or liner often result in an undesirable tear along a side of the bag, causing unacceptable product displacement from the bag, or an uneven opening. The person may resort to using a knife or scissors, possibly resulting in bodily harm to the user.

Once the carton and bag or liner have been opened, the consumer is then ready to pour the contents from the package. Due to the flexible nature of the inner bag, the actual opening through which the product flows is unpredictable. That is to say, the opening formed in the bag is not uniform or fixed. As a result, a larger than expected volume of product may unexpectedly pour from the container. Alternatively, where the inner bag has not been properly opened, product flow may be too slow. Further, although the flaps will have been folded upwardly to allow for product flow, an inherent bias or bend typically causes the flaps to extend upwardly relative to a top of the carton. Thus, the flaps will impede a user from visually confirming acceptable product volume and flow. As a result, the user may not be able to visually identify an unacceptable product flow rate until after an undesirably large volume of product has been distributed from the package. Additionally, the inner bag typically is not secured to the carton. During a subsequent pouring operation, then, the entire bag may undesirably be released from the carton. Finally, a potential concern arises relating to the ease with which a user can handle the carton during the pouring operation. To this end, the carton is typically configured to form an elongated rectangular cylinder having four rigid, ninety-degree corners. This rigid construction can render grasping of the package difficult, especially for a user with limited hand dexterity, such as a child or elderly individual.

A further consumer concern relating to box with an inner liner packaging stems from attempts to reclose the package for subsequent storage of remaining product. Again with reference to widely employed ready-to-eat cereal packaging, following dispensing of a portion of the cereal from the package, the user is then required to roll or fold the top portion of the bag or liner over onto itself so as to "close" the bag. It is not uncommon for a user to simply forget to perform this operation. Alternatively, even where an attempt is made, the bag cannot be resealed and thus remains at least partially open. Similarly, the bag may subsequently unroll. Individual cereal pieces may then undesirably be released from the bag and/or contaminants can enter into the bag. Regardless, the above-described reclosure feature associated with the carton normally does not provide an effective barrier to unexpected product displacement and/or contamination due to removal, poor design, misuse, lack of use, etc. These concerns are exacerbated when attempting to store a previously-opened package on its side or when the package is accidentally dropped. In either case, because neither the carton nor the bag provides a complete closure, unanticipated release of cereal from the container may occur.

Viewed as a whole, concerns relating to standard box with an inner liner packaging present numerous opportunities for consumer dissatisfaction. Essentially, consumer preferences for improvements to particulate-type product packaging can be separated into four categories. Consumers prefer that the package be easy to open, easily and satisfactorily reclosed, facilitate consistent and easy pouring and is acceptable for "clean" use by a child or others with limited dexterity. Obviously, consumers further prefer that product costs be as low as possible, and that certain other beneficial attributes associated with the existing box with inner liner packaging continue to be implemented. These existing properties include package strength, product damage protection, use of high volume commercially available materials, visual display of product and promotional material, recycleability, stackability, and moisture, aroma, contaminant and insect protection.

Certain packaging schemes are available that address, at least in part, several of the above-listed consumer preferences. Unfortunately, however, these packaging techniques entail other drawbacks, thereby limiting their usefulness. For example, rigid plastic containers having removable, sealable lids are available. The greatly increased costs associated with this packaging configuration prohibit its implementation on a mass production basis. Similarly, it may be possible to provide the inner bag with a "zip-lock" sealing feature. While this technique may alleviate several of the reclosure issues previously described, the zip-lock design is expensive and often times does not provide a complete seal.

Consumers continue to express a high demand for particulate-type products sold in a paper cartons. However, various problems associated with use of standard packaging, and in particular box with an inner liner packages, may diminish purchasing enthusiasm. In fact, any efforts to satisfy consumer preferences on a cost effective basis while maintaining the beneficial properties of current packaging, will likely result in heightened sales. Therefore, a need exists for a particulate-type product canister configured to address consumer use preferences.

SUMMARY OF THE INVENTION

One aspect of the present invention provides a canister for storing a particulate-type product. The canister includes a tubular body, a bottom panel, a top panel and a plurality of tabs. The tubular body defines an upper opening, a lower opening, and an internal storage region. The bottom panel is connected to the tubular body so as to encompass the lower opening. The top panel is similarly connected to the tubular body so as to encompass the upper opening and includes a lid. The lid is selectively secured to the tubular body at the upper opening such that the lid is moveable from an initial, closed state to an opened state, and from the opened state to a reclosed state. In the initial, closed state, the lid is secured to the tubular body. In the opened state, the lid is displaced from the tubular body to define a pour opening through which the internal storage region is accessible. In the reclosed state, the lid substantially encompasses the pour opening. Finally, the plurality of tabs are associated with the lid in at least the reclosed state.

During use, a user opens the canister by moving the lid from the initial, closed state to the opened state. The particulate-type product is distributed from the canister through the pour opening. Following distribution of a desired quantity of product, the lid is transitioned to the reclosed state, effectively resealing the canister. In a preferred embodiment, formation of the tabs is completed as the lid is forced from the initial closed state to the opened state, and the tabs assist in frictionally securing the lid to the tubular body in the reclosed state.

DETAILED DESCRIPTION OF THE PREFERRED EMBODIMENTS

Figure 1:
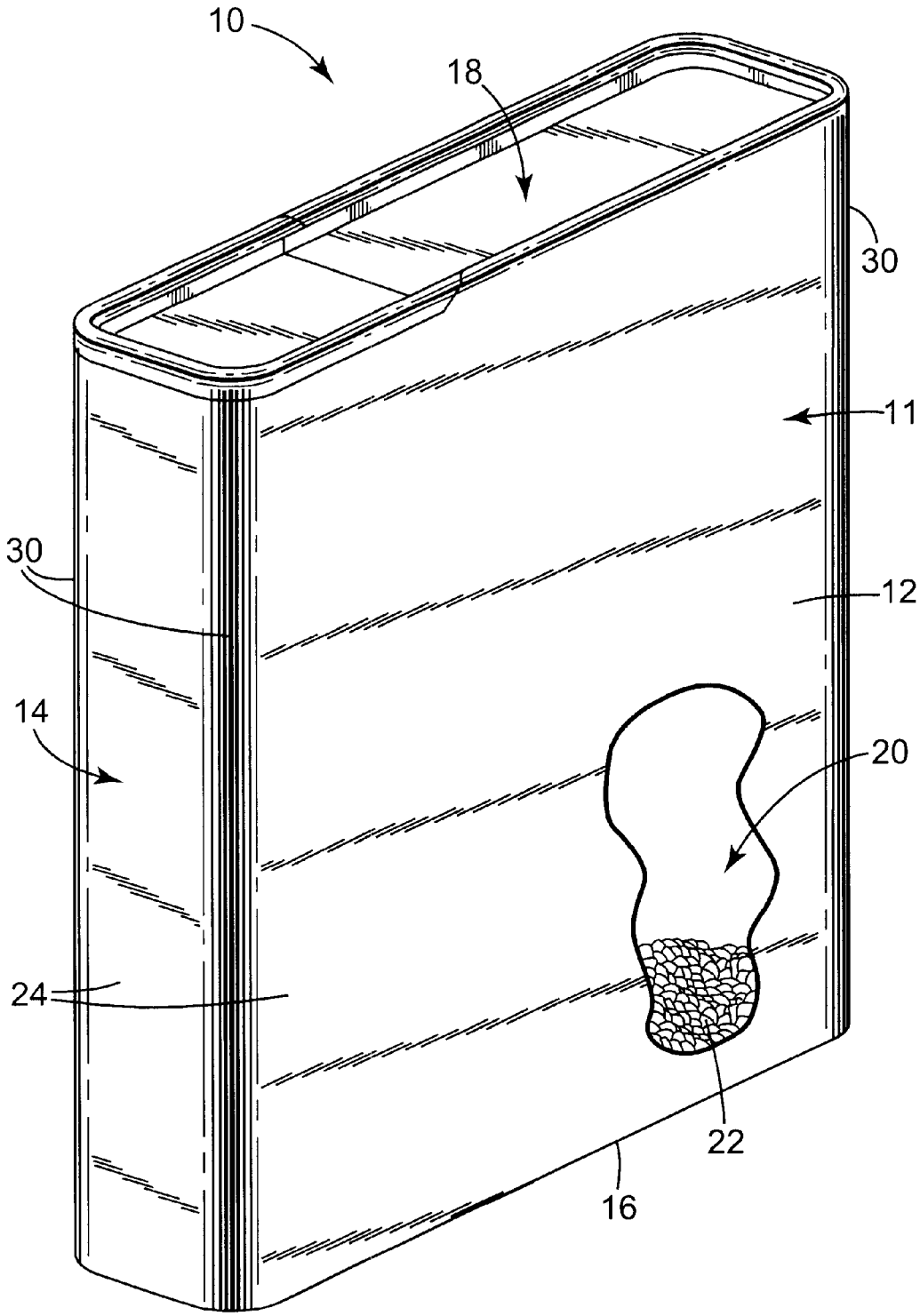
FIG. 1 is a perspective view of a canister in accordance with the present invention with a portion cut away.

One preferred embodiment of a canister 10 is shown in FIG. 1. The canister 10 includes a tubular body 11 defining opposing face panels 12 (one of which is shown in FIG. 1) and opposing side panels 14 (one of which is shown in FIG. 1), a bottom panel 16 (shown partially in FIG. 1) and a top panel 18. As described in greater detail below, the tubular body 11 integrally forms the opposing face panels 12 and the opposing side panels 14. The bottom panel 16 is connected to the tubular body 11 at a lower portion thereof. Similarly, the top panel 18 is connected to the tubular body 11 at an upper portion thereof. This configuration provides for an internal storage region 20 (shown partially in FIG. 1) within which a particulate-type product 22 is disposed. Notably, directional terminology such as "bottom," "top," "upper" and "lower" are used for purposes of illustration and with reference to a desired upright orientation of the canister 10 as shown in FIG. 1. However, the canister 10 can be positioned at other orientations such that the directional terminology is in no way limiting.

The tubular body 11, the bottom panel 16, and the top panel 18 are each formed from a paper and plastic material. For example, in one preferred embodiment, a layer of plastic is adhered or laminated to an inner surface of a layer of paper or paperboard to form each of the tubular body 11 and the panels 16, 18. Multiple layers of plastic and/or paper can also be employed. Alternatively, a plastic material or resin can be intertwined with the fibers of a paperboard. Regardless of exact construction, the resulting canister 10 is preferably formed (i.e., having an outer, paper-based layer) to allow printing or similar displays on an outer surface 24 (shown generally in FIG. 1) thereof such that the canister 10 is highly similar in appearance to currently available box with an inner liner cartons. Further, the combination paper and plastic material is preferably recyclable and provides a functional barrier to at least one of flavor, aroma, moisture, oil, grease, other contaminants, insects, etc. The selected plastic must be suitable for contact with the particulate-type product 22. For example, where the particulate-type product 22 is a food product, the selected plastic material must be approved for food contact, as is well known in the art. Thus, for example, the plastic material can be polyethylene (low density or high density), chlorinated plastic, ethylene vinyl acetate, polyester, nylon, polypropylene, etc. Even further, the plastic can be various co-polymers, blends or a combination of plastic materials.

By forming the tubular body 11 and the panels 16, 18 from a combination of paper and plastic material, the resulting canister 10 is semi-rigid (due to the paper board material), and is able to serve as a functional barrier (via the plastic material) to aroma, moisture, oil, grease or other contaminants. Thus, the canister 10 can be used to maintain a wide variety of particulate-type products. For example, the particulate-type product 22 can be a food product, and in particular a dry food product. One specific category of available food products is cereal-based products (e.g., formed from wheat, oats, rice, etc). These include ready-to-eat cereals such as puffs, flakes, shreds, and combinations thereof. Further, the ready-to-eat cereal product can include other ingredients such as dried fruits, nuts, dried marshmallows, sugar coatings etc. Alternatively, other particulate-type dry food products can be maintained by the canister 10 such as, for example, popcorn (popped or unpopped), dried pasta (e.g., spaghetti noodles), rice, beans, pretzels, potato chips, sugar, dried milk, flour, etc. Even further, other consumable items such as birdseed can be used as the particulate-type product 22. Yet even further, non-consumable particulate-type products can be stored including fertilizer pellets, dry laundry detergent, dry dishwashing detergent, plant or vegetable seeds, de-icing salt pellets, etc. Regardless of the exact product selected for the particulate-type product 22, the combination paper and plastic material comprising the tubular body 11 and the panels 16, 18 facilitates the canister 10 maintaining integrity of the product 22 independent of any additional liners or bags. That is to say, the tubular body 11 and the panels 16, 18 provide a barrier to moisture and contaminants, thereby protecting the product 22 and maintaining freshness.

In the preferred embodiment, the opposing face panels 12 and the opposing side panels 14 are preferably integrally formed as the tubular body 11. For example, an appropriately sized sheet of paper and plastic material can be wrapped about a mandrel to form the tubular body 11 that otherwise defines the opposing face and side panels 12, 14. Alternatively, the opposing face panels 12 and the opposing side panels 14 can be independently formed and subsequently secured to one another. Regardless, the opposing face panels 12 and the opposing side panels 14 are preferably sized to maintain a preferred volume of the particulate-type product 22. To this end, a resulting shape of a combination of the opposing face panels 12 and the opposing side panels 14 preferably corresponds with a shape and size of "standard" packaging normally associated with the product 22. Thus, where the product 22 is a ready-to-eat cereal, the shape and size of the opposing face panels 12 and the opposing side panels 14 is preferably highly similar to the size and shape of a carton within which the cereal is normally provided. By employing a similar package size, consumers will be familiar with and readily identify contents of the canister 10. Thus, in one preferred embodiment, the opposing face panels 12 each have a height of approximately 12 inches and width of approximately 8 inches, whereas the opposing side panels 14 each have a width of approximately 2¾ inches and a height of approximately 12 inches. Importantly, a wide variety of other sizes, either greater or smaller, and shapes are equally acceptable.

Regardless of the exact size and shape, the opposing face panels 12 and the opposing side panels 14 combine to form a plurality of longitudinally extending corners 30. In one preferred embodiment, four of the longitudinally extending corners 30 are provided (three of which are shown in FIG. 1). As illustrated in FIG. 1, each of the longitudinally extending corners 30 is preferably rounded, and thus arcuate in transverse cross-section. For example, where the tubular body 11 is fabricated by wrapping a sheet of desired material layer(s) about a mandrel (not shown) to define the face and side panels 12, 14, the mandrel can have rounded corners the shape of which is imparted into the tubular body 11. By forming the corners 30 in this manner, the canister 10 facilitates easy handling by a user (not shown). Unlike a "standard" paper carton design in which the corners are formed as sharp, ninety-degree angles, the preferred arcuate configuration of the corners 30 comfortably fits within a user's hand. This preferred feature allows a user with limited hand dexterity (such as a child or elderly individual) to easily grasp and maneuver the canister 10. While all of the corners 30 are depicted in FIG. 1 as being rounded, as few as one of the corners 30 can be so-formed yet still provide a "easy-to-handle" characteristic. Even further, one or both of the opposing side panels 14 can be rounded or bowed to facilitate easy handling.

The bottom panel 16 is sized in accordance with a cross-sectional shape of the tubular body 11. Thus, the bottom panel 16 is preferably curvilinear, having relatively straight sides and arcuate or curved corners.

Figure 2:
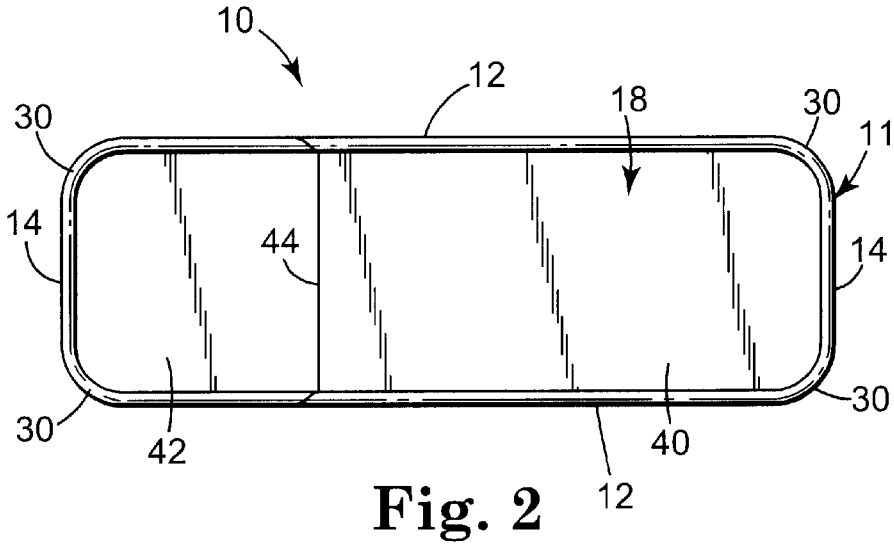
FIG. 2 is a top view of the canister of FIG. 1.

The top panel 18 is similarly sized in accordance with a cross-sectional shape of the tubular body 11. As a result, the top panel 18 preferably has relatively straight sides and arcuate or curved corners. One preferred embodiment of the top panel 18 is shown in FIG. 2. The top panel 18 is depicted as including a body portion 40 and a lid 42. As a point of reference, the lid 42 is shown in FIG. 2 in a closed position whereby the lid 42 is substantially contiguous with the body portion 40. In general terms, the lid 42 is preferably configured to be movable relative to the body portion 40. Thus, in one preferred embodiment, the lid 42 is pivotable relative to the body portion 40 along a pivot or hinge line 44. This pivoting relationship can be created by forming a bend into the top panel 18. Alternatively, an additional hinge body can be provided. Conversely, the lid 42 can be configured so as to be entirely removable from the body portion 40, such as along a perforation line. In this regard, the body portion 40 can include a ridge to which the lid 42 snap fits.

Construction and assembly of the top panel 18, and in particular, the lid 42, to the tubular body 11 preferably promotes frictional engagement therebetween upon reclosure of the lid 42. A relationship between the lid 42 and the tubular body 11 is best described with reference to three positions or states. Immediately following manufacture, the lid 42 is closed relative to the tubular body 11 in an initial, closed state, as shown in FIG. 1. Subsequently, a consumer will transition or move the lid 42 to an opened state to dispense the produce 22 from the canister 10. Following product dispensement, the lid 42 is moved to a reclosed state. As described below, while the lid 42 preferably engages the tubular body 11 (and is thus "closed") in both the initial, closed state and the reclosed state, the structural arrangement of the components is different. Further, transition of the lid 42 from the initial, closed state to the opened state preferably structurally alters the tubular body 11 and/or the lid 42 so as to facilitate subsequent engagement of the lid 42 by the tubular body 11 in the reclosed state.

Figure 3A:
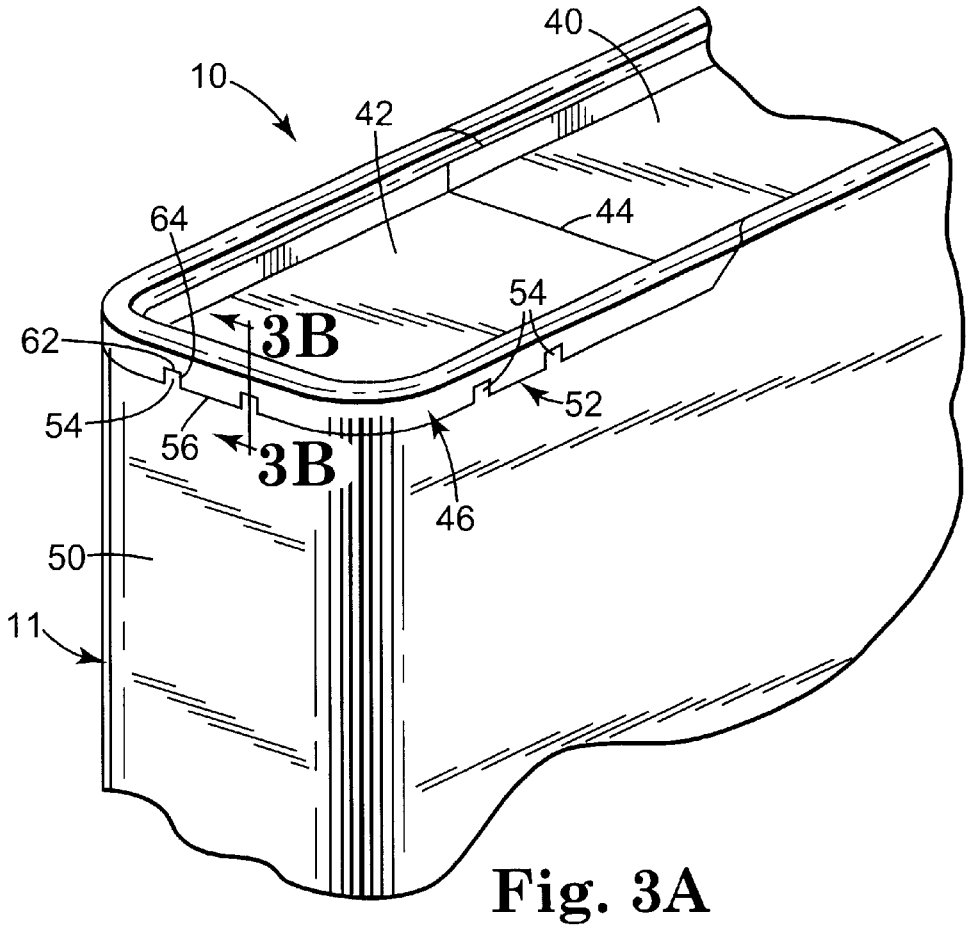
FIG. 3A is an enlarged, perspective view of a portion of the canister of FIG. 1 in an initial, closed state, illustrating a plurality of tabs.
Figure 3B:
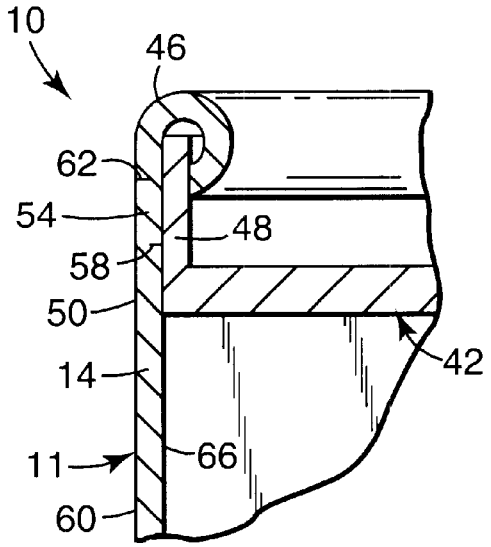
FIG. 3B is a cross-sectional view of a portion of the canister of FIG. 3A, illustrating one of the tabs.

One preferred embodiment of the canister 10 in the initial, closed state is provided in FIG. 3A. Once again, FIG. 3A depicts the canister 10 immediately following fabrication, and thus before any attempts have been made to open the lid 42. The tubular body 11 defines an upper section 46 that is secured to the top panel 18, including the lid 42. As shown in FIG. 3B, for example, the upper section 46 wraps about a lip 48 otherwise formed by the lid 42 so as to capture the lip 48. An additional adhesive (not shown) can be provided to effectuate a more complete attachment between the upper section 46 and the lip 48. As a point of reference, FIG. 3B depicts a portion of one of the side panels 14 and the lid 42, it being understood that the opposing face panels 12 are similarly secured. Further, for ease of illustration, the tubular body 11 is shown as being comprised of a single material layer, although a multi-material or —layer construction can also be employed.

The upper section 46 is separable from a remainder 50 of the tubular body by a demarcation line (shown generally at 52 in FIG. 3A) that defines a perimeter of a plurality of tabs 54. In the initial, closed state, the tabs 54 are preferably not yet complete, but instead are only partially formed. More particularly, the tubular body 11 includes a first cut 56 (shown best in FIG. 3A) and a second cut 58 (shown in FIG. 3B). A majority of the first cut extends transversely through an entire thickness of the tubular body 11 (e.g., the side panel 14 in FIG. 3B). However, the portion of the first cut 56 otherwise defining the plurality of tabs 54 extends transversely from an outer surface 60 of the tubular body 11 only partially through a thickness thereof. For example, the first cut 56 associated with each of the tabs 54 can include a lateral section 62 and a longitudinal section 64. As shown by the cross-sectional view of FIG. 3B, the lateral section 62 extends partially through a thickness of the side panel 14. The second cut 58 is formed at each of the tabs 54 opposite the lateral section 62, extending in a transverse fashion from an inner surface 66 of the tubular body 11 (e.g., the side panel 14 in FIG. 3B) partially through a thickness thereof.

Figure 3C:
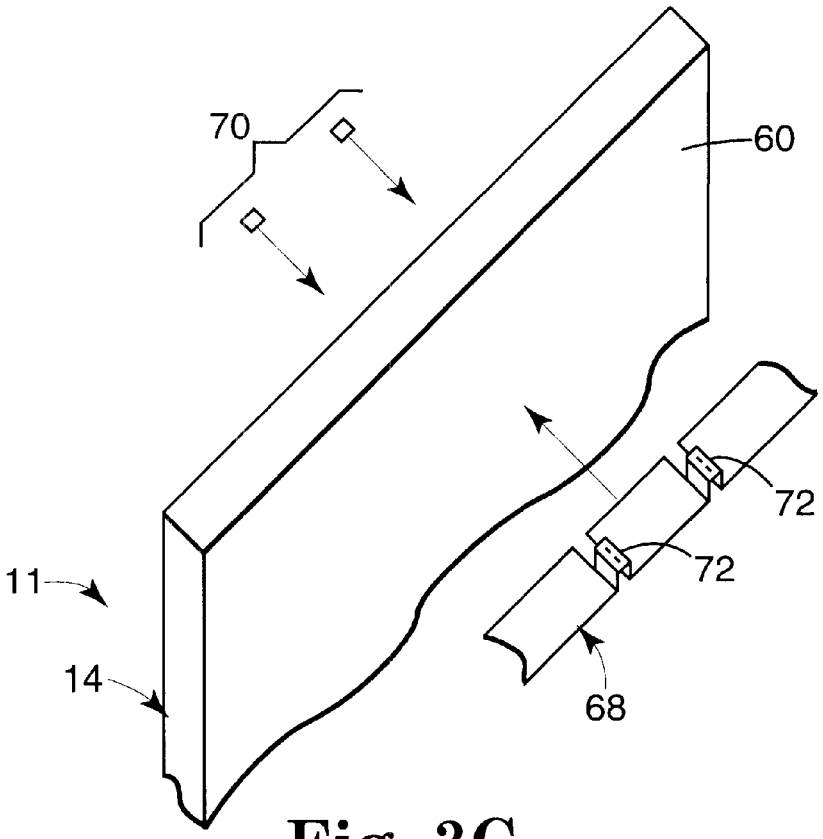
FIG. 3C is a simplified, perspective view depicting fabrication of the canister of FIG. 3A.

Formation and orientation of the first and second cuts 56, 58 is perhaps best illustrated by the simplified, perspective view of FIG. 3C, in which a portion of the tubular body 11, such as the side panel 14, in an unwrapped state, is shown relative to a first knife 68 and a second knife 70. Notably, other portions of the tubular body 11 (such as the face panels 14 (FIG. 3A)) are similarly formed, and the knives 68, 70 are greatly simplified in FIG. 3C. The first knife 68 is configured to form the first cut 56 (FIG. 3A) as it is directed through the outer surface 60, whereas the second knife 70 forms the second cut 58 (FIG. 3B) as it is directed through the inner surface 66 (hidden in FIG. 3C). The first knife 68 includes a tab forming portion 72 that is sized to extend only partially through a thickness of the side panel 14. Similarly, the second knife 70 extends only partially through the side panel 14.

Figure 3D:
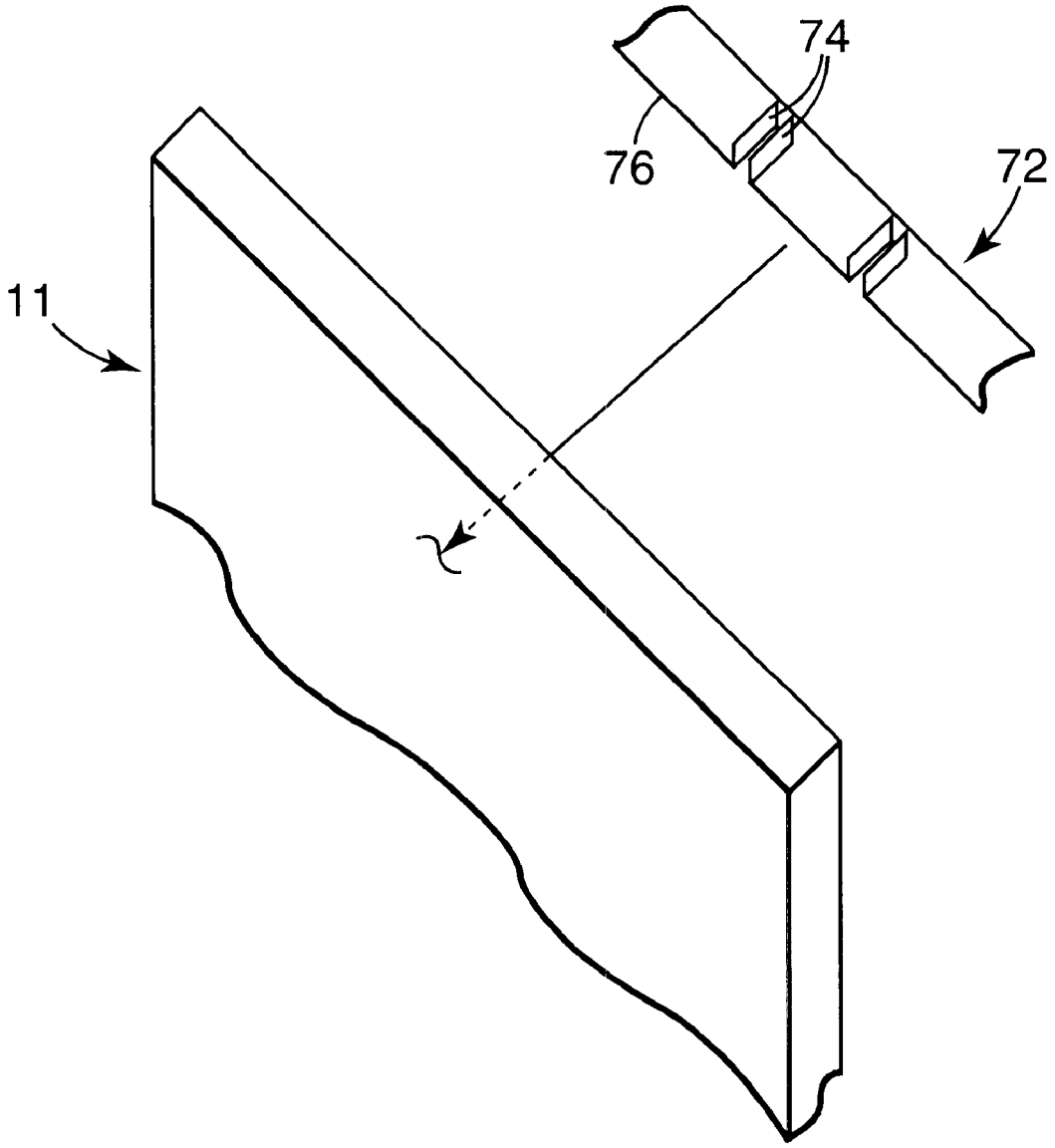
FIG. 3D is a simplified, perspective view depicting an alternative knife for fabricating the canister of FIG. 3A.

Use of the two, opposing knives 68, 70 (or a two-sided cut) to partially form or define the tabs 54 in the initial, closed state is but one acceptable technique. For example, the second knife 70 can be eliminated, such that the tabs 54 are partially formed or defined only by the first knife 68 (i.e., a single-sided cut). Even further, for example, a knife 72, as illustrated in simplified form in FIG. 3D, can be useful for partially forming or defining the tabs 54 with a single-sided cut. The knife 72 includes pairs of spaced longitudinal extensions 74 that form the longitudinal sections 64 (FIG. 3A) of each tab 54. The longitudinal extensions 74 are, in a preferred embodiment, contiguous with a leading edge 76 of the knife 72, such that the resulting cut, including the longitudinal sections 64, extends through an entire thickness of the tubular body 11 (FIG. 3) or respective panel wall. Alternatively, the longitudinal extensions 74 can be offset relative to the leading edge 76 so as to only partially cut through the tubular body 11 wall thickness (e.g. similar to the knife 68 of FIG. 3C). A variety of other single-sided cutting techniques are equally acceptable.

Figure 4A:
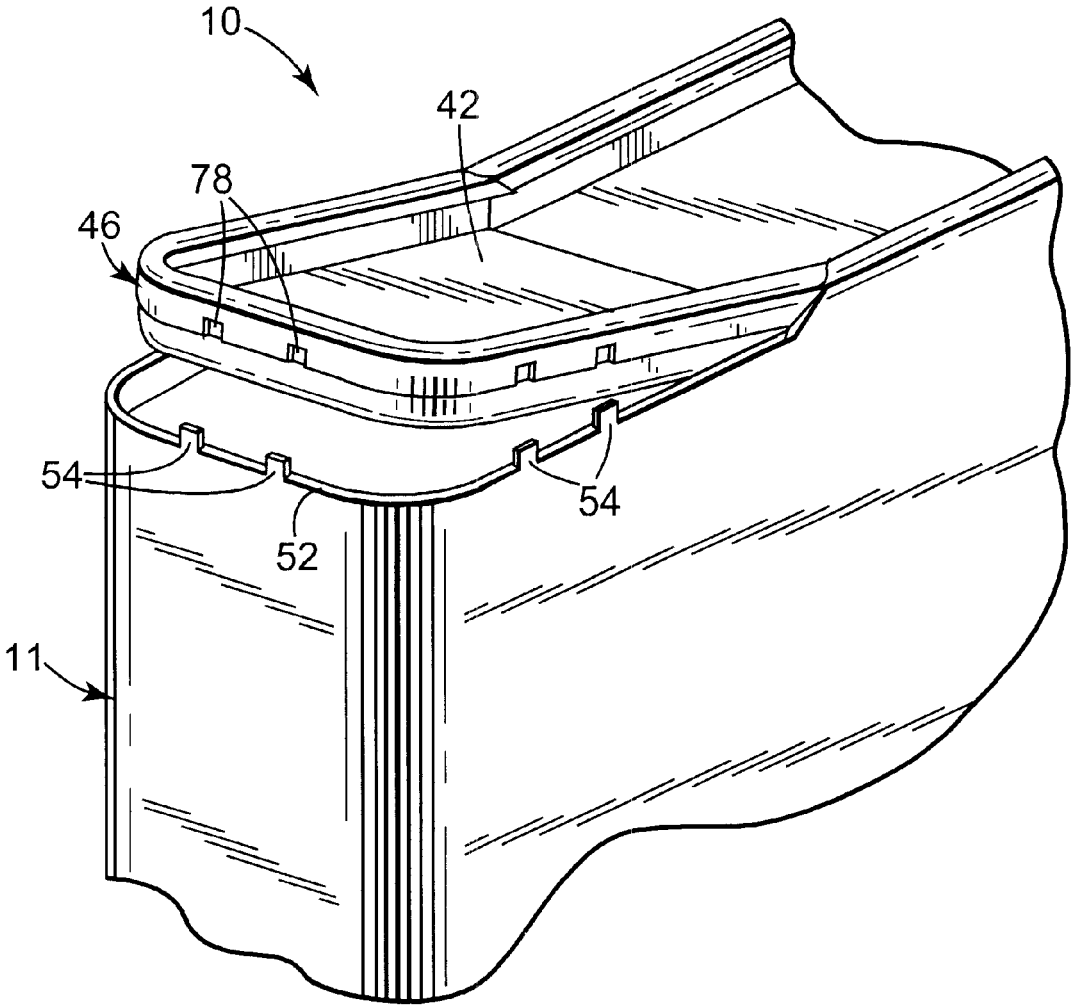
FIG. 4A is an enlarged, perspective view of a portion of the canister of FIG. 3A in an opened state.
Figure 4B:
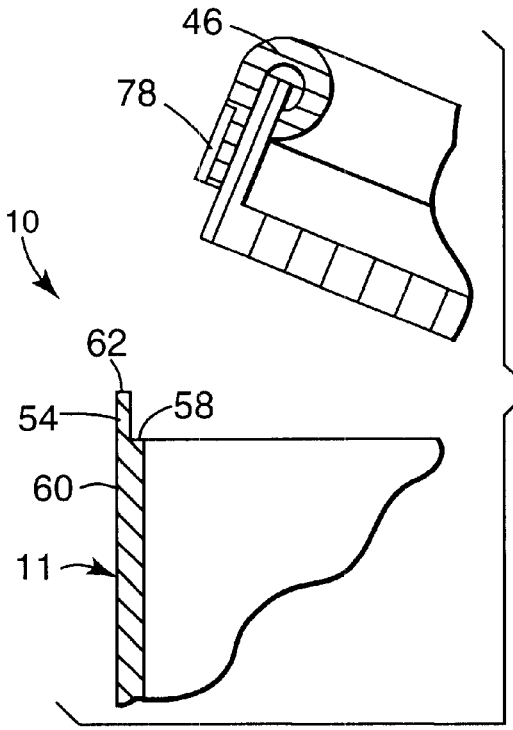
FIG. 4B is an enlarged, cross-sectional view of a portion of the canister of FIG. 4A, illustrating one of the tabs.

Regardless of how the tabs 54 are defined in the initial, closed state, the lid 42 is moveable to the opened state of FIG. 3A during use. In the preferred embodiment, as the lid 42 is transitioned from the initial, closed state (FIG. 3A) to the opened state (FIG. 4A), the upper section 46 of the tubular body 11 remains connected to the lid 42, severing from a remainder of the tubular body 11 along the demarcation line 52 (shown generally in FIG. 4A). This severing action completes formation of the tabs 54. More particularly, and with additional reference to the enlarged, cross-sectional view of FIG. 4B depicting formation of one of the tabs 54, as the lid 42 is forced away from the tubular body 11, the tubular body 11 material tears between the partial cuts 58, 62, 64 (the cut 64 being best shown in FIG. 3A), thereby allowing the upper section 46 to sever from a remainder of the tubular body 11, leaving the now-formed tabs 54 attached to, and extending from, the tubular body 11. Further, a series of recesses 78, corresponding with the tabs 54, are formed in the upper section 46 otherwise attached to the lid 42.

The preferred two-sided cut promotes tearing between the partial cuts 58, 62, 64 to complete the tabs 54. As previously described, however, the tabs 54 can be partially formed or defined in the initial, closed state through a wide variety of other techniques/knife configurations, including a single-sided cut, that also promote tab completion via tearing of the canister 10 material as the lid 42 is transitioned to the opened state. It should be noted that regardless of how the tabs 54 are initially defined, tearing morphology dictates that the tabs 54 will not necessarily have clean, linear edges as otherwise depicted in FIG. 4A. Further, depending upon whether partial or complete cuts are utilized to initially define the tabs 54, the tabs 54 can encompass a partial thickness of the wall material (as with FIG. 4A), or can have an indentical thickness.

The tearing of the tubular body 11 required to initially maneuver the lid 42 to the opened position provides a tamper-evident feature to the canister 10. In particular, a consumer will sense a minor resistance when first opening the lid 42 due to the required tearing action. Conversely, when the consumer does not defect resistance to initial movement of the lid 42 from the initial, closed state, he or she will recognize that the lid 42 has previously been opened. Alternatively or in addition, once opened, the tabs 54 will have a "torn" appearance, as will the recesses 78 formed in the upper section 46. In either case, it will be apparent to the consumer that another person has previously opened or otherwise tampered with the canister 10.

Figure 5A:
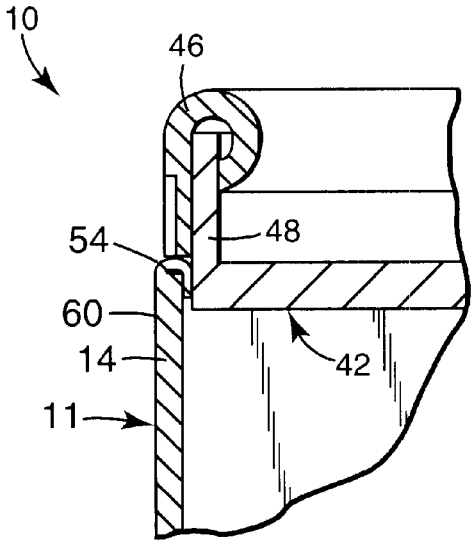
FIGS. 5A and 5B are enlarged, cross-sectional views of portions of the canister of FIG. 3A in a reclosed state.
Figure 5B:
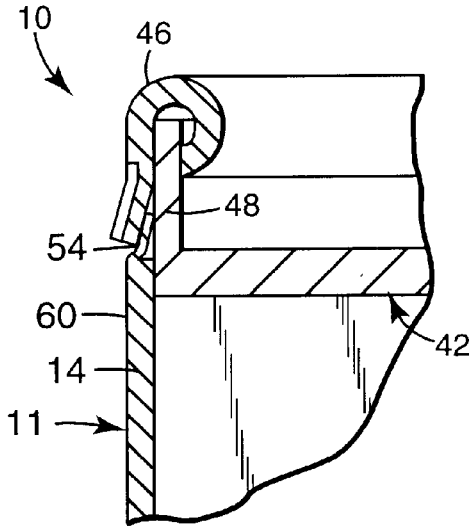

In addition to providing evidence of tampering, the tabs 54 promote frictional engagement between the lid 42 and the tubular body 11 upon subsequent movement of the lid 42 to the reclosed state. For example, shown in FIG. 5A, as the lid 42 is maneuvered back toward the side panel 14, the tab 54 can buckle and wrap around the side panel 14. As a result, the tab 54 becomes lodged between the lid 42 and the side panel 14, thereby frictionally retaining the lid 42 in the reclosed state. Alternatively, and with reference to FIG. 5B, one or more of the tabs 54 may extend between the upper section 46 and the lip 48 of the lid 42. Once again, the tab 54 thereby frictionally retains the lid 42 in the reclosed state. Notably, and with reference to FIG. 4A, it is not necessary that all of the plurality of tabs 54 frictionally secure the lid 42 to the respective panels 12, 14 in the reclosed state.

Figure 6A:
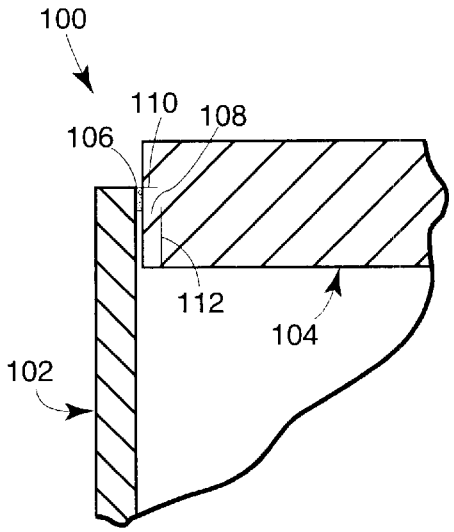
FIG. 6A is an enlarged, cross-sectional view of a portion of an alternative canister in accordance with the present invention in an initial, closed state.
Figure 6B:
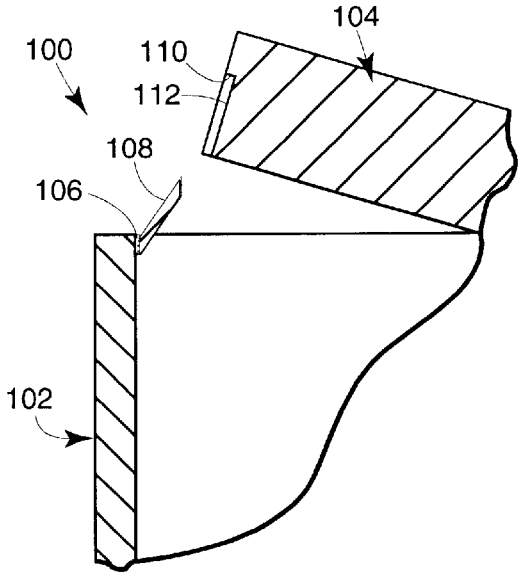
FIG. 6B is an enlarged, cross-sectional view of the canister of FIG. 6A an opened state.

While the tabs 54 have been described as preferably extending upwardly from an outer surface 60 of the tubular body 11, other configurations are equally acceptable. For example, FIGS. 6A and 6B depict an enlarged, cross-sectional view of a portion of an alternative embodiment canister 100 including a tubular body 102 and a lid 104. As with the canister 10 (FIG. 1) previously described, the portion of the tubular body 102 depicted in FIGS. 6A and 6B can be a side panel (such as the side panel 14 of FIG. 1) or the face panels (such as the face panels 12 of FIG. 1). Further, the lid 104 is preferably formed as part of a top panel (such as the top panel 18 of FIG. 1). It will be understood that the lid 104 is simplified for purposes of illustration in FIGS. 6A and 6B, and represents a structure different from that of the lid 42 (FIG. 3A) previously described. With the canister 100, the lid 104 is initially secured to the body 102 by an adhesive 106 in an initial, closed state depicted in FIG. 6A. Further, the lid 104 defines a plurality of tabs 108 (one of which is shown in FIGS. 6A and 6B). For example, each of the tabs 108 are defined by a first cut 110 and a second cut 112. As shown in FIG. 6A, in the initial, closed state, the cuts 110, 112 are not connected such that the lid 104 can be maintained in the initial, closed state of FIG. 6A via bonding of the tabs 108 to the tubular body 102 by the adhesive 106.

When the canister 100 is first opened (e.g., maneuvering the lid 104 from the initial, closed state of FIG. 6A to the opened state of FIG. 6B), the tab 108 remains secured to an inner surface 114 of the tubular body 102 via the adhesive 106. In other words, initial movement of the lid 104 to the opened state causes the lid 104 to tear along the cuts 110, 112, thereby "completing" the tabs 108. Once again, this tearing action, and the resulting defacement of the lid 104, provides a consumer with distinct evidence of possible tampering. Further, the tabs 108 provide additional material that aides in frictionally maintaining the lid 104 relative to the tubular body 102 in a reclosed state as previously described.

Figure 7A:
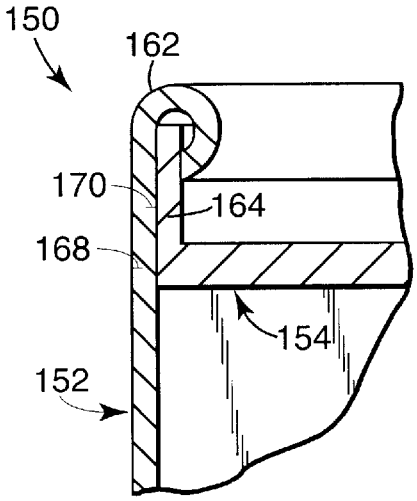
FIG. 7A is an enlarged, cross-sectional view of an alternative canister in an initial, closed state.
Figure 7C:
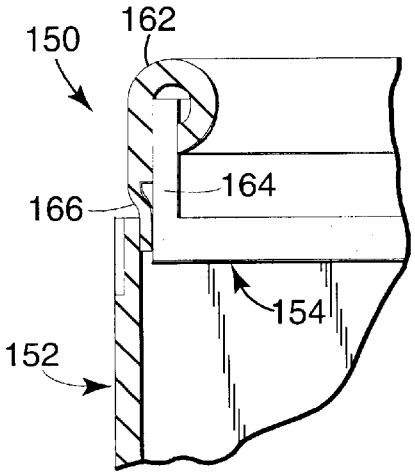
FIG. 7C is an enlarged, cross-sectional view of the canister of FIG. 7A in a reclosed state.
Figure 7B:
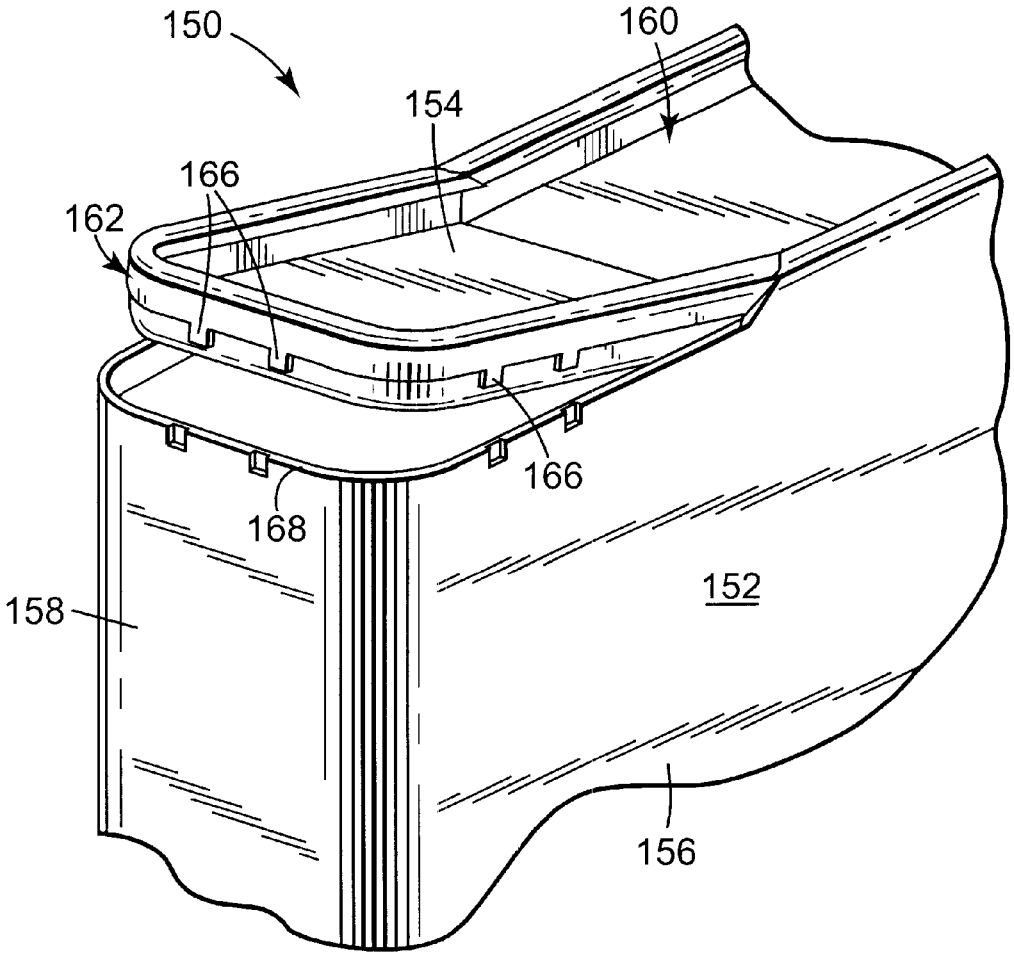
FIG. 7B is an enlarged, perspective view of the canister of FIG. 7A in an opened state.

Another alternative tab configuration is provided with an alternative embodiment canister 150 of FIGS. 7A–7C. The canister 150 is highly similar to the canister 10 previously described with reference to FIGS. 3A–3C and includes a tubular body 152 and a lid 154. Once again, the tubular body 152 preferably defines opposing face panels 156 (FIG. 7B) and opposing side panels 158 (FIG. 7B). Further, the lid 154 is formed as part of a top panel 160 (FIG. 7B). As a point of reference, then, the cross-sectional view of FIG. 7A is representative of the lid 154 assembled to the tubular body 152 in an initial, closed state. In this regard, the tubular body 152 includes an upper section 162 that is tightly wrapped about and secured to a lip 164 formed by the lid 154. Further, the tubular body 152 defines a plurality of tabs 166 for example by a first cut 168 and a second cut 170. As best shown in FIG. 7B, the first cut 168 extends transversely through an entire thickness of the tubular body 152 at all areas except in the region of the tabs 166. Similarly, the second cut 170 extends partially through a thickness of the tubular body 152 opposite the first cut 168.

As the lid 154 is transitioned from the initial, closed state of FIG. 7A to the opened state of FIG. 7B, the tubular body 152 tears between the first and second cuts 168, 170, thereby completing each of the tabs 166 as shown in FIG. 7B. Unlike previous embodiments, the tabs 166 are connected to, and extend downwardly from the upper section 162, and thus from the lid 154.

Once again, the tearing action associated with formation of the tabs 166 provides distinct evidence of tampering. Further, the tabs 166 are available to facilitate frictional engagement of the lid 154 to the tubular body 152 in the reclosed state. In particular, and with reference to FIG. 7C, as the lid 154 is maneuvered to the reclosed state, one or more of the tabs 166 will buckle and become lodged between the tubular body 152 and the lid 154 as shown. Thus, the tabs 166 assist in frictionally securing the lid 154 to the tubular body 152.

As should be evident from the above, the tabs associated with the canister of the present invention (such as the tabs 54, 108, or 166) can be formed by a variety of manufacturing techniques and can be located at different positions. In general terms, however, the tabs 54, 108, 166, are created or defined by various cuts formed during fabrication and do not include any additional features. That is to say, the tabs are not embossed or debossed, and reference to a "tab" in the specification specifically excludes an embossed or debossed article.

Figure 8:
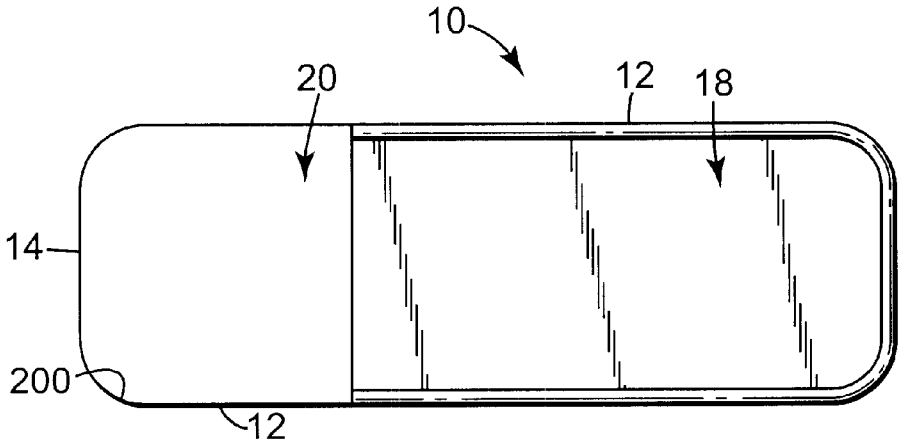
FIG. 8 is a top view of the canister of FIG. 1 with a lid portion removed.

Returning to the one preferred embodiment of FIG. 1, by preferably forming the lid 42 to be moveable, access to the internal storage region 20, and thus the particulate-type product 22, of the canister 10 is easily gained. With additional reference to FIG. 8, movement of the lid 42 to an open position generates a pour opening 200. For ease of illustration, the canister 10 is shown in FIG. 8 with the lid 42 (FIG. 2) removed. The pour opening 200 provides access to the internal storage region 20 (shown generally in FIG. 8) of the canister 10, and thus to the particulate-type product 22 (FIG. 1). The pour opening 200 can be defined by a combination of the opposing face panels 12 and the associated side panel 14, or by a perimeter of the top panel 18. Due to the relatively rigid nature of the panels 12, 14, the pour opening 200 is fixed in terms of shape and size. The pour opening 200 is preferably configured to be relatively large. For example, the pour opening 200 preferably has a width approximating a spacing between the opposing face panels 12 and length of at least one-fourth a length of the top panel 18, more preferably one-third. Alternatively, other sizes can also be useful. By providing a fixed, relatively large configuration for the pour opening 200, regulated, consistent flow of product through the pour opening 200 can be achieved as described below. In other words, the fixed pour opening 200 will not change in shape or size, unlike the standard box with an inner liner package.

Figure 9:
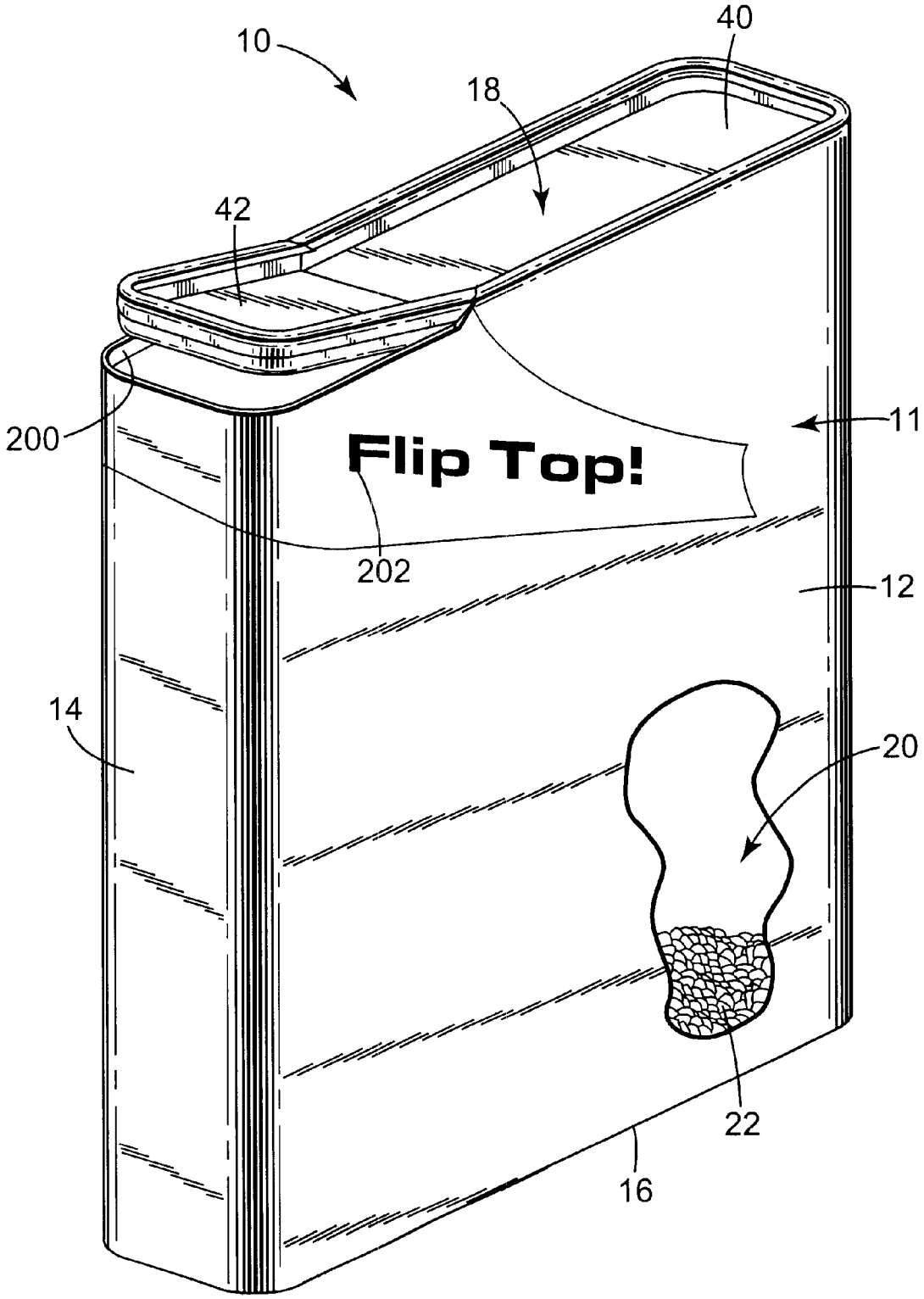
FIG. 9 is a perspective view of a canister in accordance with the present invention illustrating a movable lid portion.

Movement of the lid 42 to an open position is best shown with reference to FIG. 9. For ease of illustration, the canister 10 is shown in FIG. 9 without the tabs previously described. In one preferred embodiment, the top panel 18 is configured such that the lid 42 is independently maintained in the open position such as by friction or other mechanical means. In other words, a user (not shown) must purposely move the lid 42 to the reclosed state; the lid 42 will not unexpectedly "close" on its own. As further shown in FIG. 9, the canister 10 preferably includes indicia 202 providing visual guidance and/or instructions relating to proper operation of the movable lid 42. The indicia 202 can be formed on any of the panels 12–18, and can extend or be continuous from one panel, such as one of the opposing face panels 12, to another panel, such as one of the opposing side panels 14. The indicia 202 may assume a wide variety of forms, including words, symbols, illustrations, etc. In addition to providing instructions on operation of the movable lid 42, the indicia 202 can also be configured to draw a consumer's (not shown) attention to the movable lid feature, thereby potentially enticing a consumer to purchase the canister 10 and the product 22 contained therein.

Figure 10:
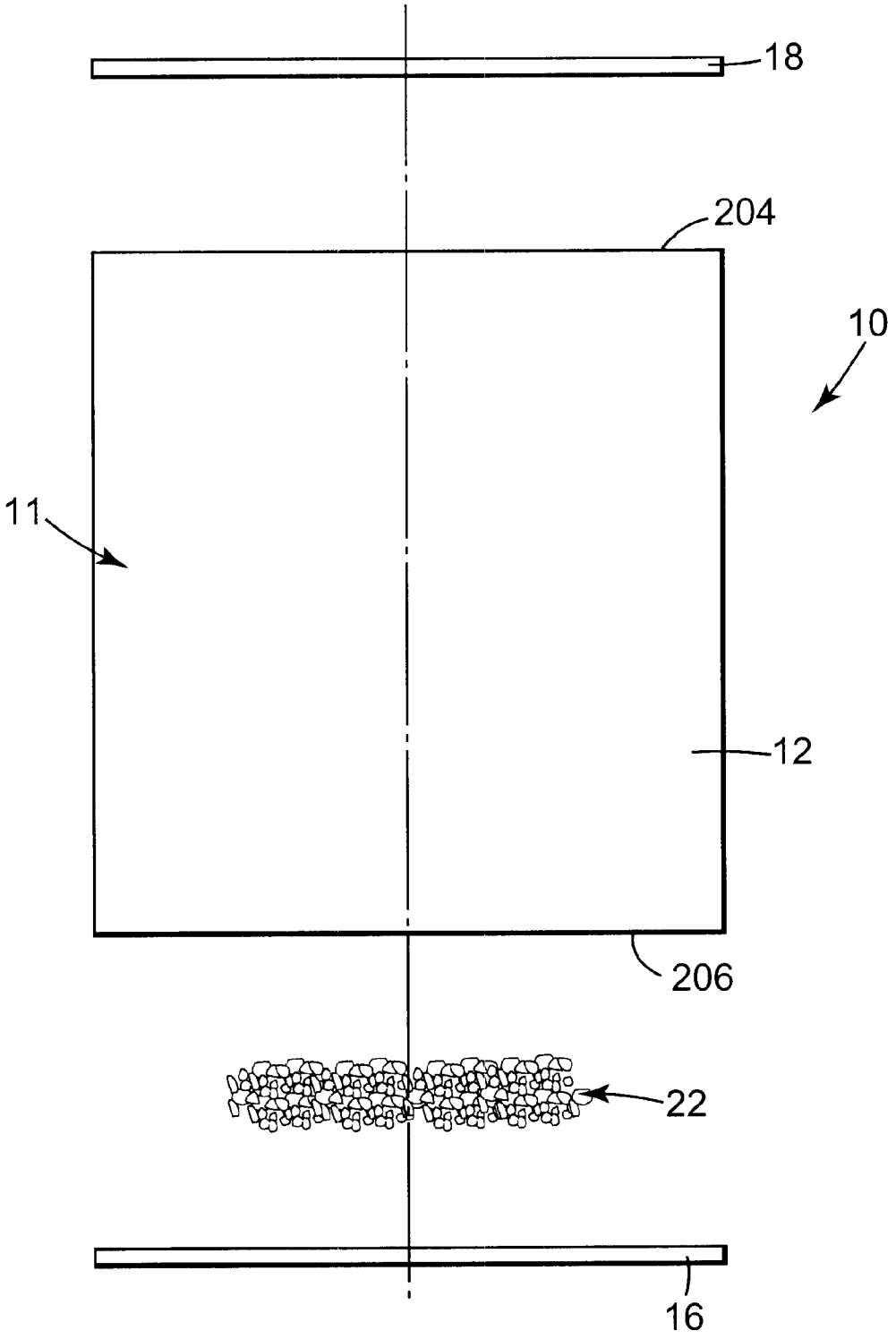
FIG. 10 is an exploded view of a canister in accordance with the present invention.

Assembly of the canister is shown generally in FIG. 10. As previously described, the opposing face panels 12 and the opposing side panels 14 are preferably integrally formed as part of the tubular body 11. In this regard, a the tubular body 11 defines an upper opening 204 (shown partially in FIG. 10) and a lower opening 206 (shown partially in FIG. 10). The top panel 18 is connected to the tubular body 11 so as to encompass the upper opening 204. For example, and as previously described, in one preferred embodiment the top panel 18 is sealed to the tubular body 11 at the upper opening 204. Alternatively, a separate attachment body, such as an adhesive, tape or laminant, or other mechanical device, can be used to affix the top panel 18. A desired volume of the particulate-type product 22 is then disposed within the internal storage region 20. Finally, the bottom panel 16 is connected to the tubular body 11 so as to encompass the lower opening 206. In one preferred embodiment, the bottom panel 18 is directly sealed to the tubular body 11. Alternatively, a separate attachment body, such as an adhesive, tape or laminant, or other mechanical device, can be used to affix the bottom panel 16. Upon final assembly, the particulate-type product 22 is sealed within the internal storage region 20.

Figure 11:
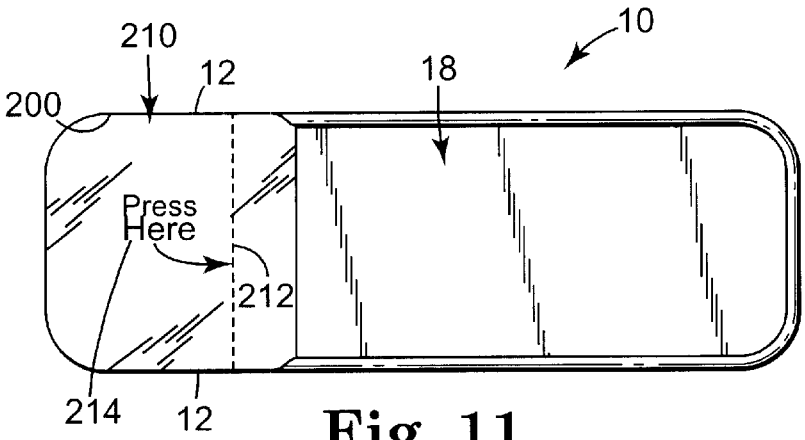
FIG. 11 is a top view of an alternative canister in accordance with the present invention with a portion removed.

During use, the lid 42 is maneuvered from the initial, closed state (FIG. 1) to the opened state (FIG. 9). For example, the lid 42 can be pivoted relative to the body portion 40 along the hinge line 44 (FIG. 2). Alternatively, the lid 42 can be entirely removed from the canister 10. Importantly, the canister 10 does not include a separate inner bag that would otherwise require opening by a user. In one preferred embodiment, to enhance a perception of product freshness and to provide an indication of product tampering, the canister 10 can further include a membrane 210 as shown in FIG. 11. For ease of illustration, the canister 10 is shown in FIG. 11 with the lid 42 (FIG. 9) removed. The membrane 210 is preferably positioned beneath the top panel 18 and extends across the pour opening 200 generated by movement of the lid 42 to the open position. For example, the membrane 210 can be adhered to an inner surface of the top panel 18, or may extend between the opposing face panels 12 at the area of the pour opening 200. The membrane 210 is preferably a thin layer comprised of a plastic, paper or combination thereof. To facilitate removal of at least a portion of the membrane 210, the membrane 210 is preferably formed to include perforations 212. The perforations 212 are preferably formed by a "skip-cut" technique, whereby a plurality of small passages or cuts are imparted through an entire thickness of the membrane 210, with each cut being separated by a small amount of membrane material. As used throughout this specification, reference to the "perforations" 212 specifically does not include an offset, double-cut technique. Additionally, the membrane 210 can include indicia 214 configured to provide visual instructions to a user of membrane removal. For example, the indicia 214 can include words, symbols or illustrations describing to a user the necessary steps for removal of the membrane 210 from the canister 10. Regardless, the membrane 210 is either completely or partially removed to expose the pour opening 200.

Figure 12:
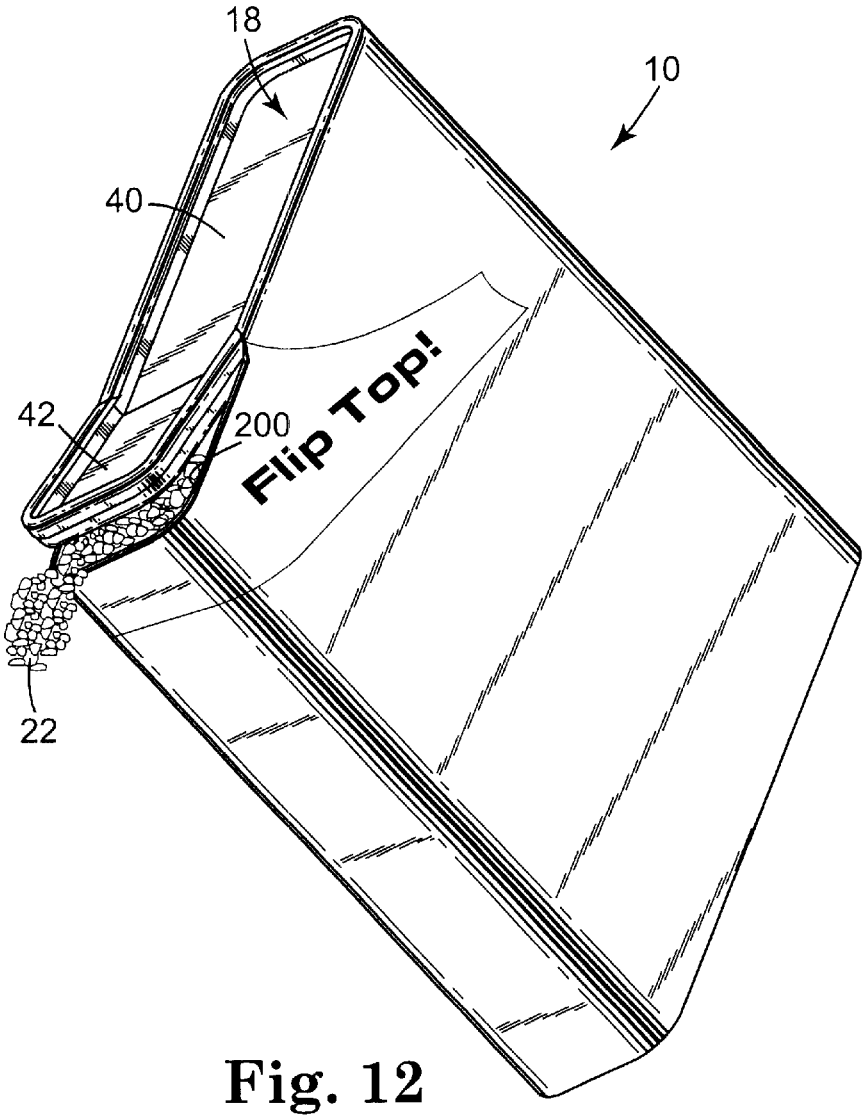
FIG. 12 illustrates a canister in accordance with the present invention in a pouring operation.

Following opening of the canister 10, a user (not shown) is then able to pour a desired quantity of the particulate-type product 22 as shown in FIG. 12. During this pouring operation, the user is able to directly confirm product flow rate and volume. In other words, unlike a "standard" box with an inner liner design, the canister 10 of the present invention does not impede the user's view of the pour opening 200. In the opened state, the canister 10 does not include any upwardly extending flaps or similar carton material that would otherwise obstruct viewing of the pour opening 200 and thus flow of the product 22 from the canister 10. Further, as previously described, the pour opening 200 is preferably fixed. Thus, a relatively consistent product flow and volume from the canister 10 can be achieved from use-to-use. Along these same lines, because the canister 10 does not require a separate liner or inner bag, the long standing problem of liner dislodgment during pouring will not occur. In short, the regulated product flow prevents an unexpectedly large volume of product from being distributed from the canister 10, and thereby minimizes spillage. As a point of reference with respect to FIG. 12, the lid 42 can be positioned or pivoted at a greater angle relative to the body portion 40 for pouring larger sized product particles.

Following distribution of a desired volume of the product 22 from the canister 10, the lid 42 is transitioned to the reclosed state. Once again, the user is not required to fold or roll a separate inner liner or bag to effectuate closure. As previously described, the lid 42 is preferably frictionally secured in the reclosed state. Thus, following use and reclosure, the canister 10 provides a relatively complete functional barrier to flavor, aroma, moisture, contaminants, insects, etc., thereby giving a perceived increase in product freshness. Additionally, by selectively securing the lid 42 in the reclosed state, the canister 10 can be placed in any orientation, whether purposefully or accidentally, without undesired spillage of the product 22 from the canister 10. In other words, during normal storage, the canister 10 is typically placed upright, supported at or by the bottom panel 16. Alternatively, however, the canister 10 can be stored in a prone position whereby the canister is supported at one of the face panels 12, the opposing side panels 14 or the top panel 18. With any of these orientations, the lid 42 remains in the reclosed state, thereby preventing accidental release of the product 22. Similarly, in the event the canister 10 is inadvertently tipped from the upright position, the lid 42 will remain in the reclosed state, again preventing accidental product spillage.

The canister of the present invention provides a marked improvement over previous designs. Pointedly, the canister eliminates the need for, and associated problems found with, a separate plastic liner or bag required by currently used box with an inner liner packaging. Persons with limited hand dexterity are no longer required to use a hand tool, such as a knife or scissors, to open the packaging. At the same time, by utilizing a combination paper and plastic material for the various panels comprising the canister, product integrity is maintained. Further, preferred features of the canister directly address consumer preferences. For example, incorporating a movable lid renders the canister easy to open and reclose. Similarly, the movable lid preferably generates a fixed opening, thereby providing for consistent, regulated product flow. Additionally, the canister of the present invention can conveniently be handled by individuals with limited hand dexterity via the preferred rounded corners. Also, tabs associated with the canister provide evidence of tampering and promote reclosure of the lid.

Although the present invention has been described with reference to preferred embodiments, workers skilled in the art will recognize that changes may be made in form and detail without departing from the spirit and scope of the present invention. For example, the canister, and in particular the tubular body has been depicted as being generally rectangular in shape. Alternatively, other shapes are equally acceptable. For example, the tubular body can be circular in transverse cross-section, such that distinct face and side panels are not defined. Also, the canister can contain items in addition to the particulate-type product. For example, a coupon or premium can be placed within the canister along with the particulate-type product.

What is claimed is:

1. A canister for containing a particulate-type product, the canister comprising:

a tubular body defining an upper opening, a lower opening, and an internal storage region;

a bottom panel connected to the tubular body so as to encompass the lower opening;

a top panel connected to the tubular body so as to encompass the upper opening, the top panel including:

a lid selectively secured to the tubular body at the upper opening, the lid being moveable from an initial, closed state in which the lid is secured to the tubular body to an opened state in which at least a portion of the lid is displaced from the tubular body to define a pour opening through which the internal storage region is accessible, and from the opened state to a reclosed state in which the lid substantially encompasses the pour opening; and a plurality of tabs associated with the lid in at least the reclosed state;

wherein at least one of the plurality of tabs is configured to frictionally secure the lid to the tubular body in the reclosed state.

2. The canister of claim 1, wherein the top panel further includes a body portion, the lid being moveably connected to the body portion.

3. The canister of claim 2, wherein the lid is hingedly connected to the body portion.

4. The canister of claim 1, wherein the canister is configured such that as the lid is moved from the initial, closed state to the opened state, formation of the plurality of tabs generates tear markings corresponding with the plurality of tabs.

5. The canister of claim 4, wherein the tear markings are formed on the tubular body.

6. The canister of claim 4, wherein the tear markings are formed on the lid.

7. The canister of claim 1, wherein the lid is frictionally connected to the tubular body by at least one of the plurality of tabs in the reclosed state.

8. The canister of claim 7, wherein a portion of the at least one tab nests between the lid and the tubular body in the reclosed state.

9. The canister of claim 8, wherein a portion of the at least one tab is captured by the lid in the reclosed state.

10. The canister of claim 1, wherein at least one of the plurality of tabs extends from the tubular body in the opened state.

11. The canister of claim 1, wherein at least one of the plurality of tabs extends from the lid in the opened state.

12. The canister of claim 1, wherein the tubular body includes an upper section secured to the lid, the upper section being separable from a remainder of the tubular body such that in the opened state, the upper section is attached to the lid and displaced from a remainder of the tubular body.

13. The canister of claim 12, wherein the tubular body includes a first cut defining a separation line between the upper section and a remainder of the tubular body, the first cut defining at least a portion of each of the plurality of tabs.

14. The canister of claim 13, wherein in the initial, closed state, the first cut extends transversely through an entire thickness of the tubular body except at a perimeter of the plurality of tabs.

15. The canister of claim 14, wherein the first cut extends transversely only partially through a thickness of the tubular body at a perimeter of the tabs.

16. The canister of claim 15, wherein the tubular body further includes a second transverse cut extending only partially through the thickness of the tubular body opposite the first cut.

17. The canister of claim 16, wherein the tubular body is defined by a first face and a second face, the first cut extending from the first face and the second cut extending from the second face.

18. The canister of claim 1, further comprising:

a membrane extending beneath the lid across the pour opening, the membrane forming perforations configured to facilitate selective removal of at least a portion of the membrane away from the pour opening.

19. The canister of claim 18, further comprising:

indicia disposed on the membrane, the indicia configured to provide visual instructions for removal of at least a portion of the membrane away from the pour opening.

20. The canister of claim 1, wherein the tubular body, the bottom panel, and the top panel are each formed from a paper and plastic material configured to maintain integrity of product contained within the internal storage region.

21. The canister of claim 1, wherein the tubular body defines opposing face panels and opposing side panels.

22. The canister of claim 1, wherein the tubular body defines a side panel extending between the bottom panel and the top panel, and at least one of the plurality of tabs initially defines a planar surface having a parallel orientation with the side panel.

23. The canister of claim 1, wherein the plurality of tabs are connected to the tubular body and the lid in the initial closed state.

24. A packaged good article comprising:

a canister including:

a tubular body defining an upper opening, a lower opening, and an internal storage region, a bottom panel connected to the tubular body so as to encompass the lower opening, a top panel connected to the tubular body so as to encompass the upper opening, the top panel including:

a lid selectively secured to the tubular body at the upper opening, the lid being moveable from an initial, closed state in which the lid is secured to the tubular body to an opened state in which at least a portion of the lid is displaced from the tubular body to define a pour opening through which the internal storage region is accessible, and from the opened state to a reclosed state in which the lid substantially encompasses the pour opening, a plurality of tabs associated with the lid in at least the reclosed state, wherein at least one of the tabs is configured to frictionally secure the lid to the tubular body in a reclosed state; and a particulate-type product disposed within the internal storage region.

25. The packaged good article of claim 24, wherein the top panel further includes a body portion, the lid being moveably connected to the body portion.

26. The packaged good article of claim 25, wherein the lid is hingedly connected to the body portion.

27. The packaged good article of claim 24, wherein the canister is configured such that as the lid is moved from the initial, closed state to the opened state, formation of the plurality of tabs generates tear markings corresponding with the plurality of tabs.

28. The packaged good article of claim 27, wherein the tear markings are formed on the tubular body.

29. The packaged good article of claim 27, wherein the tear markings are formed on the lid.

30. The packaged good article of claim 24, wherein the lid is frictionally connected to the tubular body by at least one of the plurality of tabs in the reclosed state.

31. The packaged good article of claim 30, wherein a portion of the at least one tab nests between the lid and the tubular body in the reclosed state.

32. The packaged good article of claim 31, wherein a portion of the at least one tab is captured by the lid in a reclosed state.

33. The packaged good article of claim 24, wherein at least one of the plurality of tabs extends from the tubular body in the opened state.

34. The packaged good article of claim 24, wherein at least one of the plurality of tabs extends from the lid in the opened state.

35. The packaged good article of claim 24, wherein the tubular body includes an upper section secured to the lid, the upper section being separable from a remainder of the tubular body such that in the opened state, the upper section is attached to the lid and displaced from a remainder of the tubular body.

36. The packaged good article of claim 35, wherein the tubular body includes a first cut defining a separation line between the upper section and a remainder of the tubular body, the first cut defining at least a portion of each of the plurality of tabs.

37. The packaged good article of claim 36, wherein in the initial, closed state, the first cut extends transversely through an entire thickness of the tubular body except at a perimeter of the plurality of tabs.

38. The packaged good article of claim 37, wherein the first cut extends transversely only partially through a thickness of the tubular body at a perimeter of the tabs.

39. The packaged good article of claim 38, wherein the tubular body further includes a second transverse cut extending only partially through the thickness of the tubular body opposite the first cut.

40. The packaged good article of claim 39, wherein the tubular body is defined by a first face and a second face, the first cut extending from the first face and the second cut extending from the second face.

41. The packaged good article of claim 24, further comprising:

a membrane extending beneath the lid across the pour opening, the membrane forming perforations configured to facilitate selective removal of at least a portion of the membrane away from the pour opening.

42. The packaged good article of claim 41, further comprising:

indicia disposed on the membrane, the indicia configured to provide visual instructions for removal of at least a portion of the membrane away from the pour opening.

43. The packaged good article of claim 24, wherein the tubular body, the bottom panel, and the top panel are each formed from a paper and plastic material configured to maintain integrity of product contained within the internal storage region.

44. The packaged good article of claim 24, wherein the tubular body defines opposing face panels and opposing side panels.

45. The packaged good article of claim 24, wherein the particulate-type product is a dry food product.

46. The packaged good article of claim 45, wherein the dry food product is a ready-to-eat cereal.

47. The canister of claim 24, wherein the tubular body defines a side panel extending between the bottom panel and the top panel, and at least one of the plurality of tabs initially defines a planar surface having a parallel orientation with the side panel.

48. The canister of claim 24, wherein the plurality of tabs are connected to the tubular body and the lid in the initial closed state.

49. A canister for containing a particulate-type product, the canister comprising:

a tubular body defining an upper opening, a lower opening, and an internal storage region;

a bottom panel connected to the tubular body so as to encompass the lower opening;

a top panel connected to the tubular body so as to encompass the upper opening, the top panel including:

a moveable lid secured to an upper portion of the tubular body, the upper portion being separable from a remainder of the tubular body along a cut line; and a plurality of tabs defined by the cut line.

50. The canister of claim 49, wherein the cut line is configured such that the tabs are formed as part of the upper portion.

51. The canister of claim 49, wherein the cut line is configured such that the plurality of tabs are connected to the remainder of the tubular body opposite the upper portion.

* * * * *